US005411163A

United States Patent [19]

Gueret

[11] Patent Number: 5,411,163

[45] Date of Patent: May 2, 1995

[54] CASE PROVIDED WITH A CLOSURE DEVICE NOT INCLUDING A MOVABLE MEMBER

[75] Inventor: Jean-Louis H. Gueret, Paris, France

[73] Assignee: L'Oreal, Paris, France

[21] Appl. No.: 73,464

[22] Filed: Jun. 9, 1993

[30] Foreign Application Priority Data

Jun. 9, 1992 [FR] France ..... 92 06918

[51] Int. Cl.[6] ..... B65D 45/16

[52] U.S. Cl. ..... 220/326; 220/334; 215/237; 24/324

[58] Field of Search ..... 220/326, 324, 306, 334; 215/237, 238; 24/324, 662

[56] References Cited

U.S. PATENT DOCUMENTS

| | | | |
|---|---|---|---|
| 3,390,809 | 7/1968 | Becucci | 220/326 |
| 3,825,110 | 7/1974 | Halbich et al. | 220/324 X |
| 4,344,646 | 8/1982 | Michel . | |
| 4,421,246 | 12/1983 | Schultz et al. | 220/307 |
| 4,685,558 | 8/1987 | Filiz et al. | 206/823 X |
| 4,799,604 | 1/1989 | Okojima et al. | 220/260 |
| 4,901,882 | 2/1990 | Goncalves | 220/324 |
| 4,951,692 | 8/1990 | Yuhara et al. | 206/823 X |
| 4,964,526 | 10/1990 | Stephens | 206/823 X |
| 5,135,126 | 8/1992 | Petit | 220/326 |

FOREIGN PATENT DOCUMENTS

| | | | |
|---|---|---|---|
| 0453352 | 10/1991 | European Pat. Off. . | |
| 1225177 | 6/1960 | France . | |
| 2055475 | 7/1971 | France . | |
| 2566373 | 6/1984 | France | 206/823 |
| 130772 | 5/1902 | Germany . | |
| 2160775 | 6/1973 | Germany . | |
| 1033210 | 6/1966 | United Kingdom . | |
| 2065606 | 7/1981 | United Kingdom | 206/823 |
| 2143804 | 2/1985 | United Kingdom | 206/823 |
| 2202513 | 9/1988 | United Kingdom | 206/823 |

OTHER PUBLICATIONS

French Search Report dated Mar. 10, 1993.

*Primary Examiner*—Allan N. Shoap
*Assistant Examiner*—Vanessa Caretto
*Attorney, Agent, or Firm*—Staas & Halsey

[57] ABSTRACT

Case including a lid and a base provided with a closure having a hook and a counter hook cooperating to close the case. The hook includes a rigid support on the lid to which an elastic component carrying the catch of the hook is mounted. The elastic component deforms upon opening and closing to engage and disengage, respectively, the catch and counter hook.

12 Claims, 3 Drawing Sheets

CASE PROVIDED WITH A CLOSURE DEVICE NOT INCLUDING A MOVABLE MEMBER

BACKGROUND OF THE INVENTION

This invention relates to a case of the type formed by two case halves respectively consisting of a lid and a base, intended, inter alia, to hold a make-up product in cake form, e.g. a cake of compacted powder, and possibly an applicator member, such as a powder puff or a brush. In this type of case, the lid and the base are linked along a hinge in such a manner that one can be pivoted relative to the other and closure elements are disposed on the side opposite the hinge, on the one hand, on the edge of the lid and, on the other hand, on the edge of the base. The closure elements usually consist of a hook provided with a catch and a counter hook comprising one edge of a groove formed in the wall of a recess into which the hook can penetrate, the catch cooperating with the edge of the groove in the closed position. The hook is generally disposed on the lid and the counter hook on the base, but the reverse is also possible.

The cases are usually made by molding the different components in rigid plastic. In the majority of the known cases, the counter hook of the closure device includes a sliding pusher which cooperates with a movable pivoting or sliding member, itself cooperating with the hook, the movable member making it possible to free the hook and open the case by actuating the pusher. The design and assembly of this type of closure device having a movable member are relatively complicated and require great precision. In addition, the different components obtained by molding plastic cannot be made sufficiently small and, consequently, the overall dimensions of this type of closure device are relatively large for cases intended to hold a make-up product. Moreover, the movable components are likely to wear rapidly and in the end the clasp will no longer close.

It is known from EP-A 0 453 352 to obviate the above disadvantages by making a closure device not including a movable member, comprising a hook made entirely of elastic material which is housed in a fixed and permanent manner in a blind hole of the lid of rigid material, the elasticity of the hook making it possible to open the case by exerting a force to separate the lid and the base at the closure device. However, according to this arrangement, in the end, the free part of the elastic hook which is outside the blind hole, will no longer fulfill its function after several operations, losing its elasticity as a result of fatigue.

SUMMARY OF THE INVENTION

This invention relates to a closure device by means of which it is possible to obviate this disadvantage, in which the hook consists of two parts, i.e. a rigid support molded in one piece with the case half carrying it, and an elastic component carrying the catch of the hook which is fixed to the rigid support. In this manner, the elastic component is supported by the rigid support as far as the catch and the elasticity is preserved longer during use than in the closure devices known hitherto.

This invention therefore relates to a case formed by two rigid case halves, respectively consisting of a rigid lid and a rigid base linked along a hinge, the case including a closure system consisting of two elements that can cooperate, one disposed on the edge of the lid and the other on the edge of the base on the side opposite the hinge, one of the elements being a hook provided with a catch and the other being a counter hook consisting of one edge of a groove formed in the wall of a recess into which the hook can penetrate, the catch cooperating with the said edge of the groove in the closed position. The hook consists of a rigid support molded in one piece with the case half carrying it, an elastic component carrying the catch of the hook being fixed to the rigid support.

According to the invention, the elastic component can be glued or welded on to the rigid support. It is preferably fixed using the elasticity of the elastic material from which it is made, the elastic component being held on the support to which it is fixed, e.g. by snapping, clipping, gluing or welding.

The elastic material can be any semi-rigid or flexible elastic material. Possible examples of these materials include the materials of the group formed by polyethylenes, polypropylenes, polyamides, polyacetals, thermoplastic elastomers, such as polyethylene, polyurethane, polyurethane terephthalate, polyether block amide, EVA, SBS or vulcanisable elastomers, such as nitrile, EPDM, etc..

The rigid support and the elastic component can have various shapes, the only limitations being that the rigid support can be obtained in a simple manner by molding with the case half and that the zone of the elastic component carrying the catch of the hook is sufficiently flexible to be released from the counter hook when the user exerts sufficient force to separate the lid and the base of the case at the closure device.

The rigid support according to the invention advantageously consists of at least one lug, preferably two lugs. In cross section, the lugs can have a polygonal shape, such as a rectangular, square or triangular shape, or a rounded shape, such as a circular or oval shape. Each lug can also carry projections or notches intended to improve the fixing of the component of deformable material. When there are several lugs, these are advantageously connected to one another by at least one rib, so as to reinforce their grip on the case half. This rib preferably forms an integral part of the case half.

The elastic component advantageously has a shape such that it can be slipped like a sock or a glove on to the lug (or lugs) forming the rigid support. To this end, it can consist of a casing including a cavity into which the lug (or all of the lugs) can be slipped or a casing including a cavity for each of the lugs.

The elastic component can also be fixed to the support by snapping or clipping fixing lugs which it carries.

In order to improve the flexibility of the elastic component in the vicinity of the catch, the zone of the component carrying the catch can be a thin zone at right angles with a recess of the component or the zone can be a tongue.

BRIEF DESCRIPTION OF THE DRAWINGS

The object of this invention will be more readily understood from the following description of several embodiments given purely by way of non-limiting examples and with reference to the accompanying drawings, in which.

DESCRIPTION OF THE PREFERRED EMBODIMENTS

Figure 1:
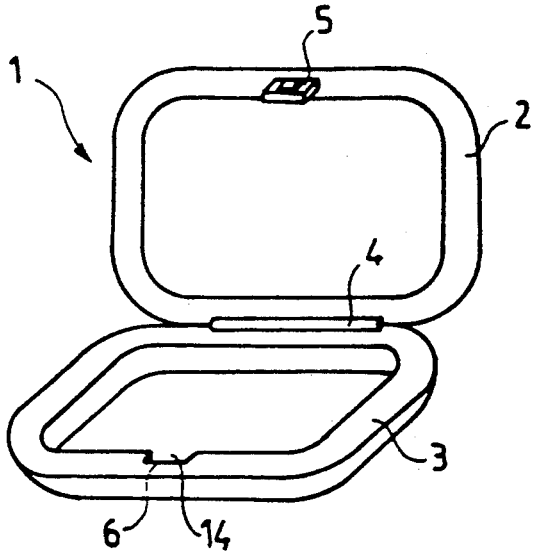
FIG. 1 is a perspective view of an open case including a closure device according to the invention.
Figure 2:
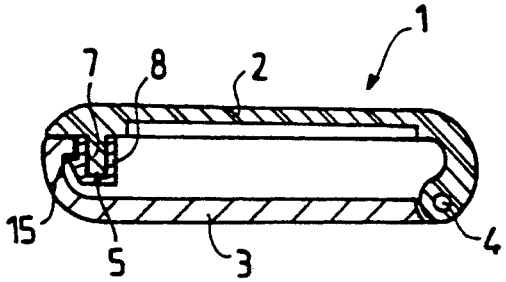
FIG. 2 is a section of the same case in the closed position.
Figure 3:
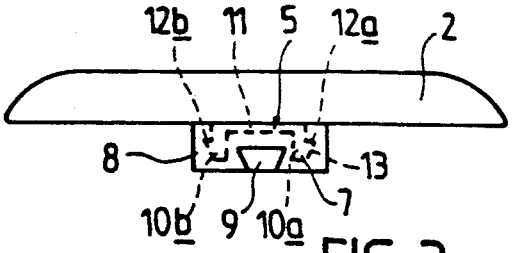
FIG. 3 is a front view of the lid of the case carrying the hook.

FIGS. 1 to 3 show a case 1 according to the invention which includes a lid 2 and a base 3 molded in rigid material connected along a hinge 4. The closure device of the case 1 consists of two elements, i.e. an element 5 forming a hook which is disposed on the edge of the lid 2 opposite the hinge 4 and an element forming a counter hook 6 which is disposed on the edge of the base 3 opposite the hinge 4 so that it can cooperate with the element forming the hook 5.

The element 5 consists of two parts, i.e. a support 7 which is molded in one piece with the lid 2 and which is consequently made of rigid material and an elastic component 8 which carries a catch 9 of the hook 5. The support 7 consists of two lugs 10*a* and 10*b* connected by a reinforcing rib 11 which is integral with the bottom of the lid 2. The lugs 10*a* and 10*b* have a cross section in the shape of a rectangle except at their free ends where the lugs 10*a* and 10*b* carry a projection 12*a*, 12*b* having a longitudinal section in the shape of a right-angled triangle, the point of the right angle being opposite the bottom of the lid. The elastic component 8 is a parallelepipedal casing in which a cavity 13 having the shape of the support 7 is formed. The catch 9 is disposed on the front face of the component 8 and it projects towards the exterior.

The counter hook 6 consists of the edge of a groove 15 formed in the wall of a recess 14.

When the case 1 is closed (see FIG. 2), the hook 5 is housed in the recess 14, the catch 9 cooperating with the edge of the groove 15 and being held by the upper edge (in the position shown in FIG. 2) of this groove 15. When the user wishes to open the case 1, he exerts a force on the closure device tending to separate the lid 2 from the base 3 at the closure. Under the action of this force, the elastic catch 9 is deformed until the catch 9 is freed from the groove 15 and, consequently, the hook 5 is freed from the counter hook 6. When the user closes the case 1 again, the catch 9 of the hook 5 moves aside by deformation and then is housed in the groove 15.

The subsequent figures show variants of closure systems according to the invention. In these figures, the same arrangements or components carry the same reference numerals increased by multiples of 100.

Figure 4:
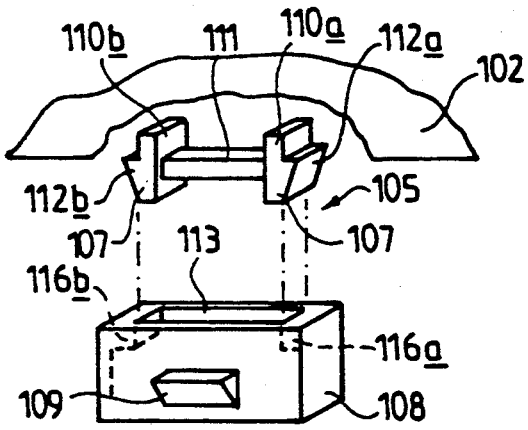
FIGS. 4 to 6 are exploded views of different embodiments of the hook according to the invention, in which the support includes lugs which have a polygonal shape in cross section and are slipped into the interior of the elastic component.

FIG. 4 is an exploded perspective view of a hook 105 consisting of a support 107 and an elastic component 108 carrying a catch 109. The support 107 has the same shape as the support 7 shown in FIGS. 1 to 3, except that the reinforcing rib 111 is not integral with the lid 102. The component 108 is a parallelepipedal casing open on its upper face (in the position shown). A cavity 113 is formed in the casing 108 and is also parallelepipedal in its entirety, except that beading 116*a*, 116*b* is provided to hold the projections 112*a* and 112*b* of the lugs 110*a*, 110*b* molded in one piece with the lid 102.

Figure 5:
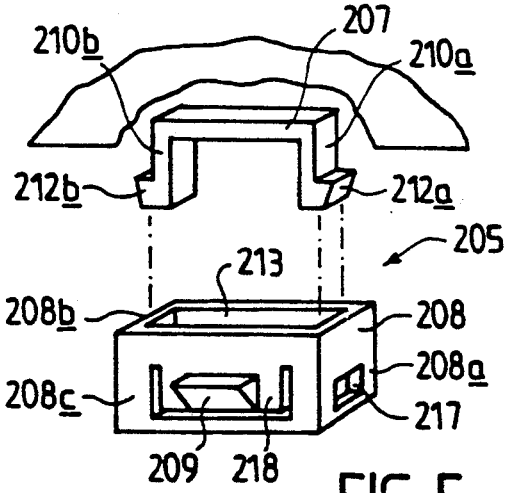

FIG. 5 shows a variant of the hook 105 of FIG. 4. According to this Figure, a hook 205 consists of a support 207 similar to the one shown in FIGS. 1 to 3, except that the projections 212*a* and 212*b* of the lugs 210*a* and 210*b* have a longitudinal section in the shape of a right-angled trapezium, the small side of the trapezium having a length slightly greater than the thickness of the wall of the elastic component 208. The elastic component 208, like the component 108 of FIG. 4, consists of a hollow casing including a parallelepipedal cavity 213. Two openings 217 for the passage of the projections 212*a* and 212*b* of the rigid support 207 are formed in the lateral walls 208*a*, 208*b* of the casing, just above the wall forming the base. A rectangular tongue 218 carrying the catch 209 is provided in the front wall 208*c* of the casing. This gives greater flexibility of the catch of the hook 209, thereby facilitating opening and closure of the case.

Figure 6:
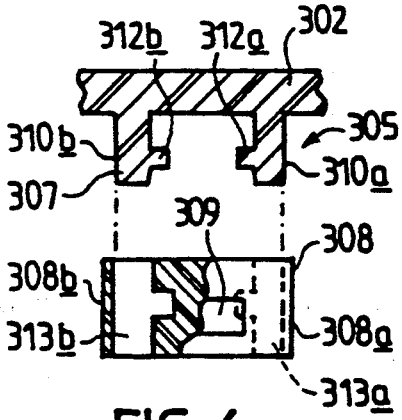

FIG. 6 is an exploded view, partly in section and partly in a front view, of a hook 305 the support 307 of which consists of two lugs 310*a* and 310*b* provided with two projections 312*a* and 312*b* facing one another. The elastic component 308 is of generally parallelepipedal shape and carries a catch 309. Two passages 313*a* and 313*b* having a shape complementary to that of the lugs 310*a* and 310*b*, except for the necessary clearance, and bordered by the lateral walls 308*a* and 308*b* are formed in the component 308.

Figure 7:
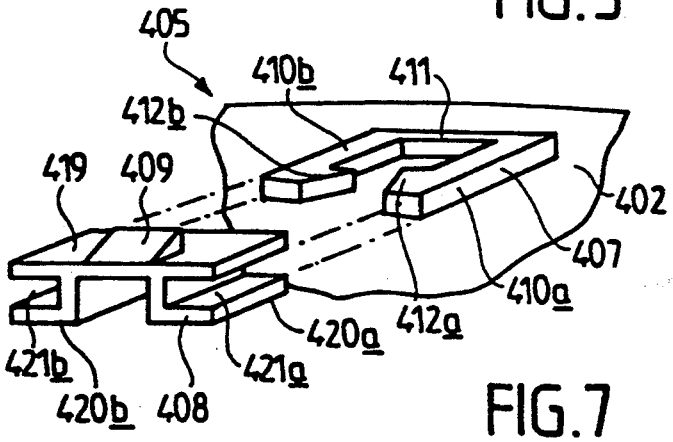
FIG. 7 is an exploded view of an embodiment of the hook, in which the support is fixed by snapping to the fixing lugs of the elastic component.

FIG. 7 is an exploded view of a hook 405 which consists of a support 407 including two lugs 410*a* and 410*b* connected by a rib 411 integral with the lid 402 shown vertically here. The lugs 410*a* and 410*b* are provided at their ends with triangular projections 412*a* and 412*b* respectively facing one another. The elastic component 408 consists of a plate 419 on the upper face of which the catch 409 is disposed. Two fixing lugs 420*a* and 420*b*, each in the form of a right-angled bracket, are disposed on the lower face of the plate 419, one of the sides of each bracket 420*a* and 420*b* being parallel to the plate 419 and the other being perpendicular to the plate 419. These brackets form two rectangular spaces 421*a* and 421*b*, each space 421*a*, 421*b* having cross-sectional dimensions equal to the dimensions of the lugs 410*a*, 410*b* outside the projections 412*a* and 412*b*. These project beyond the component 408 when the latter is mounted on the support 407. The component 408 is thus fixed to the support 407 with the aid of fixing lugs 420*a* and 420*b* and projections 412*a* and 412*b*. In this embodiment, the catch 409 is situated over a flexible zone of the plate 419 facilitating the operation of the catch 409 in cooperation with the corresponding counter hook.

Figure 8:
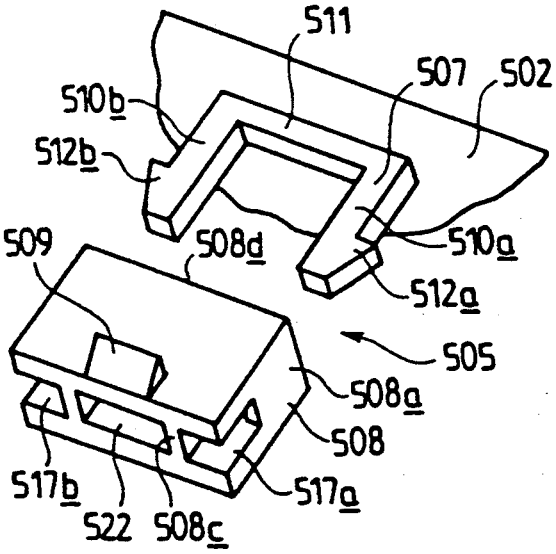
FIG. 8 is an exploded view of another embodiment of the same type of hook.
Figure 9:
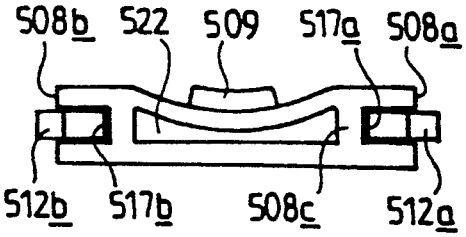
FIG. 9 is a front view of this same hook.

FIGS. 8 and 9 show an embodiment of a hook 505 consisting of a support 507 molded in one piece with the lid 502 and an elastic component 508 carrying the catch 509 of the hook. The support 507 consists of two lugs 510*a* and 510*b* carrying two projections having a triangular longitudinal section 512*a*, 512*b* directed towards the exterior. The lugs 510*a* and 510*b* are connected to one another by a reinforcing rib 511 integral with the lid 502. The component 508 is a parallelepipedal casing, the rear face 508*d* of which (in the position shown in FIGS. 8 and 9) is open, this opening extending as far as the front wall 508*c* by openings 517*a*, 517*b* at each of the corners between the lateral walls 508*a* and 508*b* and the front wall 508*c*. The openings 517*a*, 517*b* have dimensions such that the projections 512*a*, 512*b* can penetrate therein and hold the component 508 by clipping, as shown in FIG. 9, on the edges of the openings 517*a*, 517*b* defined by the lateral walls 508*a*, 508*b*. A rectangular opening 522 traverses the component 508 at right angles with the catch 509 and gives greater elasticity to the hook 505 at the catch 509. FIG. 9 shows this elasticity being used to advantage during the operation of the closure device.

Figure 10:
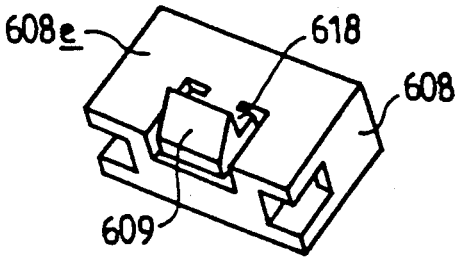
FIG. 10 is a perspective view of an elastic component which can be fitted to the support of FIG. 8.

FIG. 10 shows an elastic component 608 which can be used with the support 507 shown in FIG. 8. This component 608 is similar to the component 508 shown in FIGS. 8 and 9, except that the flexibility of the hook at the catch 609 is obtained by a tongue 618 cut out of the upper wall 608*e* of the component 608 and carrying the catch 609.

Figure 11:
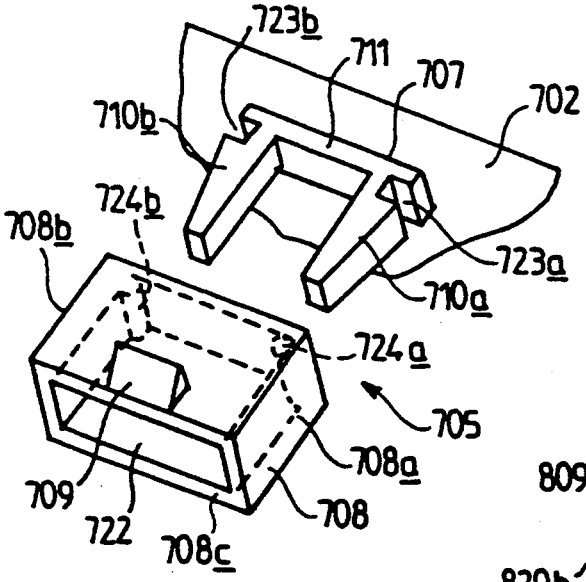
FIG. 11 is an exploded view of a variant embodiment of the hook of FIGS. 4 to 6.

FIG. 11 shows a hook 705 consisting of a support 707 of rigid material and an elastic component 708 carrying the catch 709. The support 707 includes two lugs 710*a*, 710*b* connected by a rib 711 integral with the lid 702. The lugs 710*a*, 710*b* have a cross section which gradually decreases from the rib 711 towards their free ends. An outer lateral notch 723*a*, 723*b* is formed at the reinforcing rib 711 in each of the lugs 710*a*, 710*b*. The elastic component 708 is a hollow prismatic casing. The lateral faces 708*a* and 708*b* converge slightly towards the front wall 708*c*. They are provided internally on their edges opposite the lid 702 with beading 724*a* and 724*b*. A front cutout 722 of generally rectangular shape is formed on the front wall 708*c*. The catch 709 is thus disposed on the flexible upper wall limiting the opening 722 of the component 708.

Figure 12:
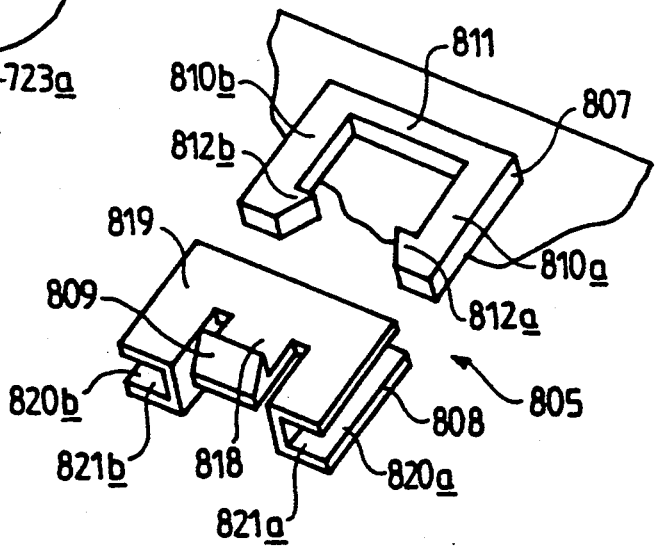
FIG. 12 is an exploded view of an embodiment of a hook, in which the elastic component includes lugs for fixing the support by snapping.

FIG. 12 shows a hook 805 consisting of a rigid support 807 and a flexible component 808. The rigid support 807 includes two lugs 810*a*, 810*b* connected at one of by a reinforcing rib 811 which is integral with the lids 802. The free ends of the lugs 810*a*, 810*b* carry a projection 812*a*, 812*b*, the two projections facing one another. The elastic component 808 consists of a plate 819 provided on its lower face with two lugs 820*a*, 820*b* in the form of a right-angled bracket forming a space 821*a*, 821*b* opening laterally towards the exterior. This space has dimensions such that the lugs 810*a*, 810*b* can be introduced therein, the projections 812*a* and 812*b* being disposed on the front edge of the lugs 820*a* and 820*b* so as to fix the component 808 by clipping to the lugs 810*a*, 810*b*. The catch 809 of the hook 805 is disposed on a tongue 818 formed on the front edge of the plate 819.

Figure 13:
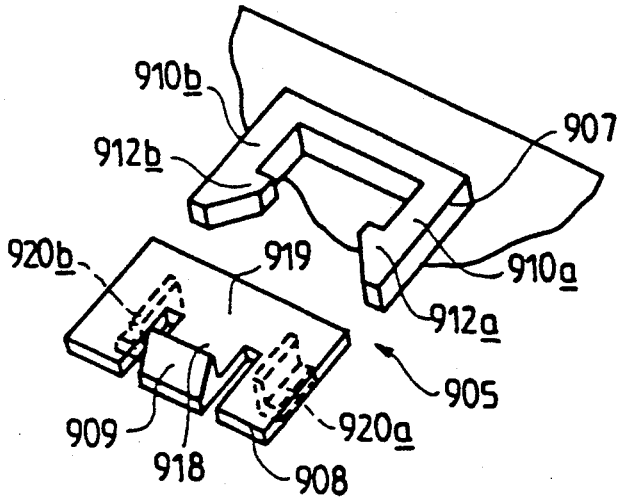
FIG. 13 is an exploded view of a variant embodiment of the hook of FIG. 12.
Figure 14:
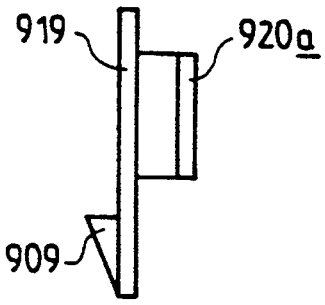
FIG. 14 is a section of the flexible component of FIG. 13.

FIGS. 13 and 14 show an embodiment of a variant of the hook 805 of FIG. 12. In the elastic component 908, the lugs 920*a*, 920*b* each include an angle return, the two returns facing one another, and are disposed on the lower face of the plate 919. The catch 909 of the hook is fixed to a tongue 918. The lugs 910*a*, 910*b* of the support 907 include lateral projections 912*a*, 912*b* facing one another.

Figure 15:
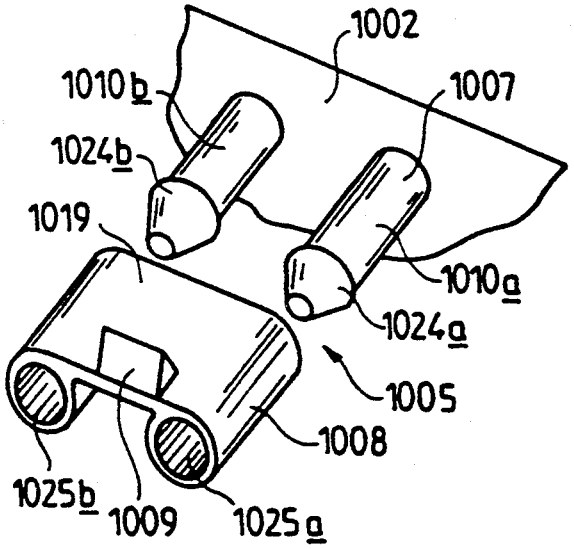
FIG. 15 is an exploded view of an embodiment of the hook, in which the lugs are cylindrical.

FIG. 15 shows a hook 1005 consisting of a support 1007 including two cylindroconical lugs 1010*a* and 1010*b* molded in one piece with the lid 1002. On each lug 1010*a*, 1010*b*, the diameter of the conical part at its junction with the cylindrical part is greater than the diameter of the cylindrical part so as to form a collar 1024*a*, 1024*b* defining around and at the ends of the cylindrical parts a flat bearing surface opposite the lid. The elastic component 1008 consists of a plate 1019 carrying the catch 1009 of the hook. Two cylindrical spaces 1025*a*, 1025*b* are provided under the face of the plate 1019 at each of the ends of the plate 1019. The lugs 1010*a* and 1010*b* slip into the spaces 1025*a*, 1025*b* like into the fingers of a glove, the clipping collars 1024*a* and 1024*b* holding the component 1008 relative to the support 1007 by bearing against the flat bearing surfaces of the lugs 1010*a*, 1010*b* on the front face of the component 1008.

Figure 16:
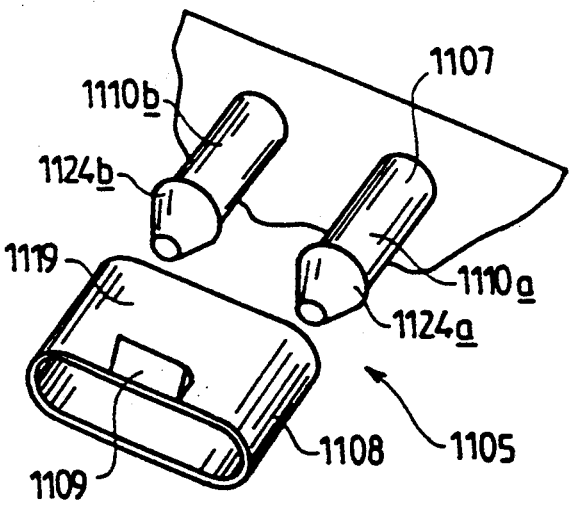
FIG. 16 is an exploded view of another embodiment of the hook of the same type as that of FIG. 15.

FIG. 16 shows a hook 1105 consisting of a rigid support 1107 and an elastic component 1108. The rigid support 1107 consists of two cylindroconical lugs 1110*a* and 1110*b* similar to the lugs 1010*a*, 1010*b* of FIG. 15. The component 1108 consists of an endless belt 1119 which can be straddled over the lugs 1110*a* and 1110*b*. The belt 1119 carries the catch 109 of the hook on its front edge (in the position shown in FIG. 16).

I claim:

1. A case including first and second rigid case halves movable between open and closed positions, and a closure system for holding the case in the closed position, the closure system comprising:

a first element disposed on the first case half and including a rigid support fixed stationary on and projecting from the first case half, and a separate component formed of a material having elasticity that is fixed around the rigid support, said separate elastic component including a catch; and a second element disposed on the second case half and including a receptacle fixed stationary at an edge of the second case half for engaging the catch, wherein, when the case is closed and pressure is applied to open the case, a portion of the elastic component deforms, allowing the catch to disengage from the receptacle and allowing the case to open and, when the first half is closed relative to the second half, the portion of the elastic component again deforms, allowing the catch to engage the receptacle and allowing the case to remain closed.

2. The case according to claim 1, wherein the elastic component is made from a material selected from the group comprising polyethylenes, polypropylenes, polyamides, polyacetals, thermoplastic elastomers and vulcanizable elastomers.

3. A case including first and second rigid case halves connected to be movable between open and closed positions and a closure system for holding the case in the closed position, the closure system comprising:

a first element disposed on the first case half and including a hook having a rigid support fixed stationary on the first case half, said rigid support being in the form of two lugs with a space formed between the lugs, and an elastic component carrying a catch and being fixed to the lugs, the catch being located adjacent the space; and a second element disposed on the second case half and including a counter hook in the form of a groove formed in an edge of the second case half for cooperating with the catch when the case is in the closed position, wherein, when the case is closed and pressure is applied to open the case, a portion of the elastic component deforms, causing the catch to move from a first position toward the space and disengage from the counter hook, thereby allowing the case to open and the catch returns to the first position and, when the first half is closed relative to the second half, the portion of the elastic component again deforms, causing the catch to move from its first position toward the space and engage the counter hook and the catch returns to the first position, thereby allowing the case to remain closed.

4. The case according to claim 3, wherein the elastic component is fixed to rigid support due to the elasticity of the elastic component.

5. The case according to claim 3, wherein the elastic component is made from a material selected from the group comprising polyethylenes, polypropylenes, polyamides, polyacetals, thermoplastic elastomers and vulcanizable elastomers.

6. The case according to claim 3, wherein in cross section, each of the two lugs has one of a polygonal and rounded shape.

7. The case according to claim 3, wherein the two lugs are connected to each other by a reinforcing rib.

8. The case according to claim 3, wherein the elastic component includes a cavity in which both of the two lugs are received.

9. The case according to claim 3, wherein the elastic component includes two cavities, each of which receives one of the two lugs.

10. The case according to claim 3, wherein the elastic component includes projecting members for cooperating with the two lugs to hold the elastic member on the rigid support.

11. The case according to claim 3, wherein the elastic component includes an area upon which the catch is formed said area corresponding to said space formed in said rigid support.

12. The case according to claim 3, wherein the elastic component includes an area upon which the catch is formed, said area being a tongue.

* * * * *